United States Patent [19]

Shapiro

[11] Patent Number: 4,657,186

[45] Date of Patent: Apr. 14, 1987

[54] STREAM FORMER

[76] Inventor: Eugene B. Shapiro, 1250 Rudolph Rd., Northbrook, Ill. 60062

[21] Appl. No.: 784,372

[22] Filed: Oct. 4, 1985

[51] Int. Cl.[4] ..... B05B 1/14

[52] U.S. Cl. ..... 239/462; 239/590.3; 239/590.5; 239/600; 239/DIG. 23

[58] Field of Search ..... 239/462, 428.5, 590.3, 239/590.5, 553.3, 553.5, DIG. 18, DIG. 23, 600

[56] References Cited

U.S. PATENT DOCUMENTS

| | | | |
|---|---|---|---|
| 2,210,846 | 8/1940 | Aghnides | 239/428.5 |
| 2,328,381 | 8/1943 | Jaffe | 239/428.5 |
| 2,618,511 | 11/1952 | Wahlin | 239/590.3 |
| 3,138,332 | 6/1964 | Hinderer | 239/590.3 |
| 3,428,258 | 2/1969 | Duggan | 239/590.3 |
| 3,730,440 | 5/1973 | Parkison | 239/590.5 |

FOREIGN PATENT DOCUMENTS

| | | | |
|---|---|---|---|
| 1217858 | 5/1960 | France | 239/590.3 |
| 688161 | 2/1953 | United Kingdom | 239/590.3 |

*Primary Examiner*—Andres Kashnikow
*Assistant Examiner*—Michael J. Forman
*Attorney, Agent, or Firm*—Norman Lettvin

[57] ABSTRACT

A new and improved stream former is provided for attachment to the discharge end of a faucet or the like. The stream issuing from the stream former provides a formed, coherent, non-splash, silent, gentle flow. The stream former includes a sleeve-like casing, of metal or plastic, with an upstream attachment means, and a pair of axially spaced inwardly projecting supports defined on the inner wall of the sleeve-like casing, downstream of the attachment means. A transverse, fine-mesh, support screen is supported on the downstream support. A plastic, cup-shaped, molded transverse member is supported on the upstream support. A plurality of transverse, axial flow holes are provided through the apertured transverse wall of the cup-shaped transverse member. A closely woven, non-shedding, foraminous mat of nylon fibers is positioned between said transverse wall of the upper transverse member and the fine-mesh screen support. The ratio of downstream outlet area of the stream former to area of discharge through the upstream apertured transverse wall is about 30:1. The discharge from the stream former is silent and provides a coherent stream that is silky to the touch, and discharges less than 2.75 g.p.m. at an upstream feed pressure of 85 PSI.

14 Claims, 4 Drawing Figures

FIG. 1
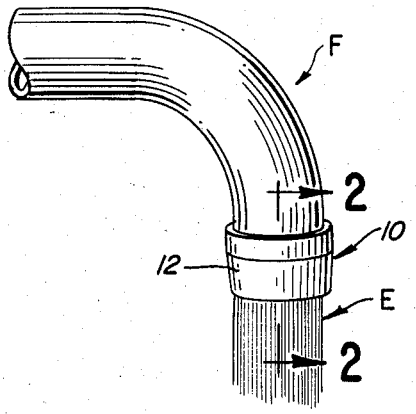
FIG. 2
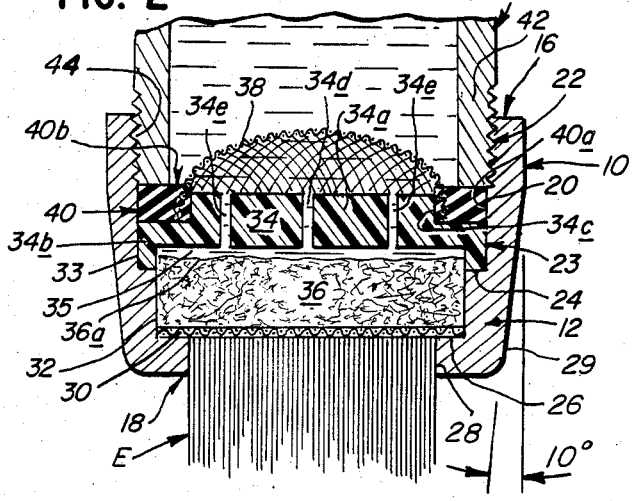
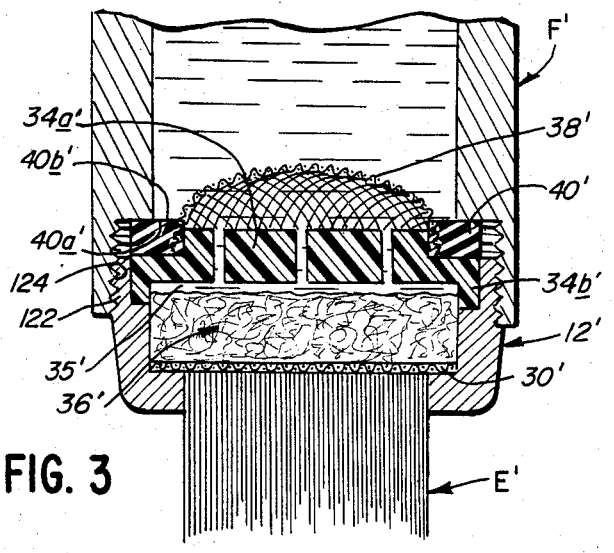
FIG. 3
FIG. 4
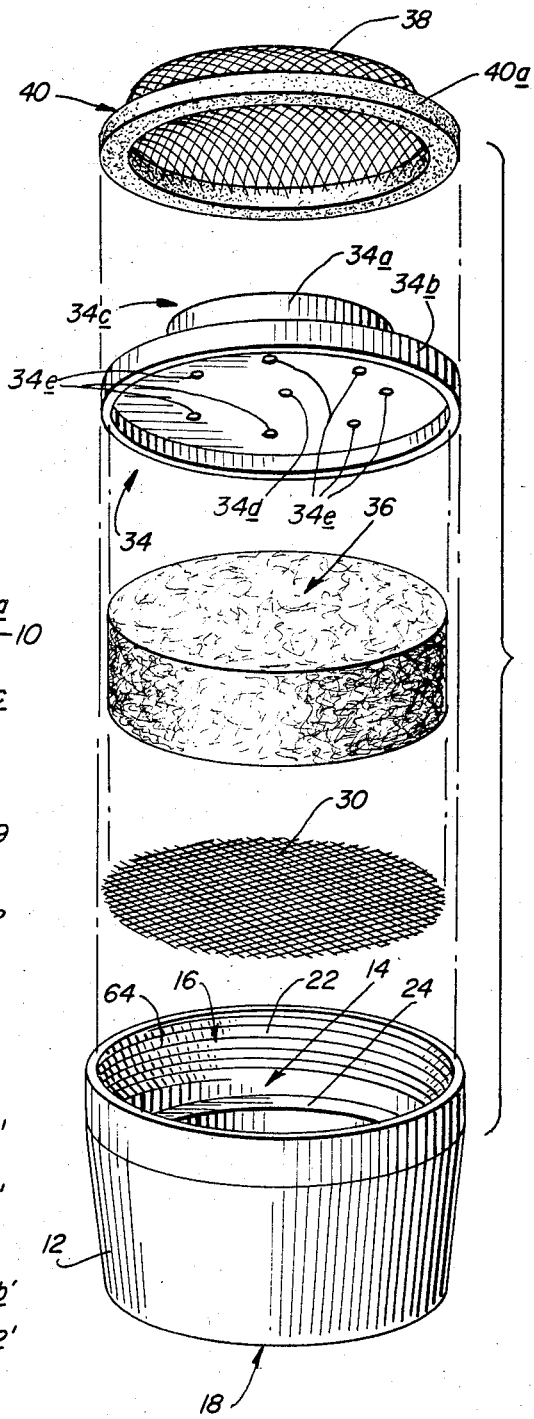

STREAM FORMER

FIELD OF THE INVENTION

This invention relates to an improved water discharge nozzle or stream former, and more particularly to a stream former that provides both an improved, soft, coherent discharge stream with non-splash character, and a discharge volume that conforms to water conservation recommendations issued by governmental bodies.

BACKGROUND OF THE INVENTION

Faucets, or the like, which provide for selectively controlled discharge of water, in stream form as usually provided in sinks, are well known. High velocity discharge, of coherent aerated streams issuing from faucet aerators, result in some stream spreading as the stream issues from the aerator and in some undesirable splash, and more importantly results in flow discharge rates that do not meet present water conservation recommendations.

It has long been known, since about late in the 1940 decade in the U.S., to use, at the discharge end of faucets, devices known as faucet aerators, which mix, or entrain air into a high velocity faucet discharge to provide for the dicharge of a bubbly mixture of water and air that substantially, but not fully, reduces undesirable splash of the discharging water stream, and provides a softer "feel" of the discharging stream than would be the case if an aerator was not used.

In recent years, convervation of water resources in urban communities has been urged, and recommendations have been voiced by governmental bodies and others to regulate water consumption by reducing discharge flow from faucets and other water discharging devices such as shower heads. The conversation trend and concurrent flow discharge limitations have proved to be difficult to attain, because aerated water requires a substantial upstream flow velocity and volume to effect ingestion of the requisite amount of air necesary to provide a bubbly, relatively soft, coherent stream of discharged water, which homemakers have become accustomed to use in the United States and in other countries since the late 1940s.

The presently mandated limits of discharge from a faucet or shower head has been set by some government bodies in the United States at not in excess of about 2.75 gallons per minute (g.p.m.), under an upstream delivery pressure to the faucet or shower head of water at 85 pounds per square inch (85 psi). Typical examples of proposed, or adopted, specifications are: (a) in New York State—not in excess of 3 g.p.m.; and (b) in some water-starved communities in California—not in excess of 2 g.p.m.

Attempt have been made to meet the recommended standard for discharge by a shower head, of not in excess of 2.75 g.p.m. of water at a water delivery pressure, of 85 psi. One attempt, disclosed in U.S. Pat. No. 3,831,860, has sought to use a flow-restricting plate upstream of a flow-discharging shower head, where the flow-restricting plate is single-orificed and serves to choke down the total water flow downstream thereof. It has been observed that such a flow restrictor, when used with an aerator, appears to interfere with the obtaining of what appears, to the user of the flow appliance, to be an adequately-sized discharge, which the householder has become accustomed to using, or the discharge of water from the appliance is so reduced in vigor, or speed, as to make the appearance and feel of the discharge seem inadequate to the user. The g.p.m. discharge through such a centrally apertured flow control plate has been measured at about 3 g.p.m. from a shower head appliance using 85 psi water upstream of the flow control plate.

Use of restricted upstream orifices in connection with a device for producing a coherent aerated flow from a faucet is shown in such U.S. Patents as Nos. 2,316,832; 2,849,217; 3,138,332 and in others patents.

OBJECTS OF THE INVENTION

One object of this invention is to provide a discharge nozzle, or stream former for the discharge end of a kitchen or lavatory faucet, or the like, which will meet water-conservation requirements, while at the same time providing a coherent, shape-retaining, discharge flow of water that is soft, silent, non-splash, and should prove to be acceptable to housewives, or others who use water discharged from a kitchen skin faucet, or lavatory faucet.

Another object of this invention is to provide a novel, simple, and inexpensive arrangement of parts for a discharge nozzle, to be aattached at the discharge end of a kitchen sink faucet or the like, and which nozzle serves as a stream former to produce a non-spreading, coherent, stream of liquid that is of a desirable cross-sectional discharge size favorably comparable to an aerated stream of water, and which produces a non-splash stream that is not aerated, as the term "aerated" has come to be known in the prior art, and with the discharging stream providing a silky feel that does not splash when flowing against or over solid objects placed in the path of the discharging stream of water.

The stream former of this invention provides an issuing discharge stream therefrom that has substantially uniform cross-sectional area and has practically no tendency to spread, so that the stream is substantially a cylinder of flowing water that is coherent and of an area size comparable to that of an aerated stream, but the issuing stream is not aerated, and it is discharged at a slower speed than the discharge of an aerated stream of water, resulting in providing a volume discharge within the limits prescribed by the water conservation requirements that today exist in certain areas of the United States.

Further objects and advantages will become known to those skilled in the art from the following description of the invention disclosed herein.

BRIEF DESCRIPTION OF THE DRAWINGS

A preferred form of the invention is shown in the accompany drawings wherein:

FIG. 1 illustrates, in fragment, the discharge end of a kitchen sink faucet with the stream former of this invention attached to the discharge end of the faucet, and showing a coherent stream being discharged therefrom;

FIG. 2 is an enlarged cross-sectional view of the stream former of this invention that employs a female-threaded casing for connection to the male-threaded discharge end of a faucet, and is taken substantially along line 2—2 of FIG. 1;

FIG. 3 is a view similar to FIG. 2, but showing a male-threaded casing for connection to a female-threaded discharge end of a faucet; and FIG. 4 is an exploded, perspective, view of the elements of the stream former shown in FIG. 2.

DETAILED DESCRIPTION OF THE INVENTION

Referring first to FIG. 1, a stream former constructed in accord with this invention is shown generally at 10, coupled to the discharge end of a faucet F and having a coherent stream of water, bounded by a substantially cylindrical, imaginary, envelope E, discharging from the lower end of the improved stream former 10.

As is best seen in FIGS. 2 and 4 the stream former 10 includes an axially elongated, tubular or sleeve-like housing, or barrel, 12 that is provided with an upstream central bore 14, seen in FIG. 4, and having an upper, female-threaded, inlet end 16 located where the stream former 10 is to be coupled to a male-threaded liquid discharge faucet pipe, F, and with said barrel 12 having a stream-forming discharge end 18 through which fluid is discharged.

The upper portion of the central bore 14 of barrel 12 is provided with a counterbore 20 of an enlarged diameter, the upper end of which is threaded as at 22, so as to provide a female-threaded coupling for complementary threading to male threads 44 provided on the exterior of end portion 42 of the liquid discharging faucet pipe F.

The counterbore 20 extends axially below female-threaded section 22, and serves to define a cylindrical sleeve 23 that extends below threads 22 down to an inturned, annular support shoulder, 24 provided on housing 12. There is also provided a second, downstream, inturned, annular support, flange, or shoulder, 26 provided on housing 12, which is of smaller innermost dimension than shoulder 24, and whose innermost dimension defines a lowermost, stream defining, discharge edge, or aperture, 28 located at the discharge end 18 of housing 12. The diameter of discharge aperture 28 is 0.69 inches, so that the area of discharge at the downstream end of stream former 10 is about 0.3737 square inches.

The barrel, or housing, 12 of the stream former may be formed of metal, such as brass, or of a molded plastic, such as Delrin®, both of which materials are shape retaining for the intended purposes disclosed herein. In the specific form shown, barrel 12, made of free machining, plateable, brass, permits machining of the barrel, including machining, or otherwise shaping, the exterior of the lower end of barrel 12 to provide an exterior, downstream projecting, conical taper 29 of the outer surface, of about ten degrees (10°) as shown in FIG. 2. This conically tapered wall 29 may be provided with a medium-knurl on the surface, as is known in the art, to provide for manual purchase, or gripping, of the barrel when manually attaching the barrel 10 to the discharge end of faucet F.

The inturned, downstream, annular support surface 26 has mounted thereon a circular screen disc 30, of fine mesh, in this instance specifically 40-mesh, whose outer peripheral edge preferably slidably enters, and may engage against, the downstream, cylindrical, inner wall 32 defined in the downstream end of barrel 12 directly upstream of the inturned flow-defining annular support 26. The barrel 12 provides an upstream cylindrical inner wall section 33, that is part of counterbore 20, and which is concentric with, but of larger inner diameter than that of the downstream cylindrical wall 32.

The other internal parts of stream former 10 include: an upstream flow-control, molded disc, generally indicated at 34; a cylindrical, axially compressible, flow-through disc, generally indicated at 36, in the form of a foraminous pad of closely woven, non-shedding, matted nylon fibers, through which water will flow; and an upstream fine-mesh filter screen, of about 60-mesh, shown at 38, and shaped in the form of an aarched dome whose center portion projects upstream, and whose outermost peripheral edge extends downstream and outwardly, somewhat frusto-conically at the outermost portion as shown in FIGS. 2 and 3, and embedded at its outermost extent in a molded, resilient, compressible, annular seal member, or gasket, 40. The combination of a screen 38 and a gasket-like, annular seal member, is a part that is available from plumbing parts suppliers.

The flow-control disc 34 is preferably molded of "Delrin" ® and includes a central, axially thickened, flow-control portion **34*a* with a plurality of axially-extending, cored and molded flow holes extending axially therethrough. The diameter of flow-control portion 34*a* is less than the internal diameter of faucet pipe F. Disc 34 is a unitary member shaped to provide a reduced thickness, annular, disc-like flange that projects outwardly of flow-control portion 34*a* to merge into a downstream extending, cylindrical, sleeve-like, spacer flange 34*b* that extends down-stream from the plane of central portion 34*a* of disc 34, and slidably telescopes into upstream annular recess 34*c* that surrounds the part of the disc's central portion 34*a* that extends upstream of downstream extending flange 34*b***.

As one example of dimensions used, the flow-control portion **34*a* of disc 34 has one axially extending, centrally located, cored bore 34*d* therethrough of diameter 0.059 (+0.000/−0.0011) inches, spaced from and surrounded by seven, smaller cored bores 34*e*, that are equally circumferentially spaced on a diameter of a circle of 0.380 inches, and with each hole 34*e* having a bore size of 0.042 (+0.000/−0.001) inches, with no flash permitted in the cored bores. The total flow-through area, provided by the single central bore 34*d* and the seven bores 34*e*, is about 0.01242 square inches. The ratio of the downstream discharge area of stream former 10, defined by discharge aperture 28 to the total water inlet area through flow-control disc 34** is 0.3737/0.01242 or about 30:1.

It will be understood that different dimensions and ratios of areas can be also used, but the dimensions disclosed herein are but one specific example of a device made and tested.

The inner wall of barrel, or housing, 10 is shaped to provide an annular upper support shoulder 24 upon which the lower edge of peripheral flange **34*b* rests. The outer periphery of flange 34*b* is in slidable, or press fit, relation with inner wall 33 of the barrel 12**.

The upstream filter screen 38 and its attached compressible seal member 40 are positioned upstream of the flow-control disc 34, with the outermost diameter of annular seal member 40, indicated at **40*a*, of a size to sealingly abut the inner wall of casing 12 and be substantially aligned with the outer periphery of flange 34*b* of the flow-control disc 34. The outer periphery of flange 34*b* of flow-control disc has a snug, or press-fit, contact with the surrounding surface 33 of barrel 12**.

Upstream of disc flange **34*b*, the barrel of housing 12 has an axial extension of cylindrical surface 33 against which the outermost surface 40*a* of annular compressible seal member 40 is to be compressed to form a watertight seal, when the barrel, or casing 12 is screwed tightly onto the male-threaded terminus 42 of faucet F. Compression of watertight seal 40 causes seal member 40: (a) to bulge radially inwardly against the surrounded adjacent side surface 34c of central thickened portion 34a of flow-control disc 34; (b) to bulge radially outwardly against the upstream section of cylindrical inner barrel wall 33**; and (c) to seal against the downstream edge of faucet F, thereby providing seals that prevent water leakage at all said regions of abutment.

The pad 36 of nylon fiber was obtained by cutting a cylindrical pad, or disc, from a non-compressed, nylon fibre pad material, that is sold under the mark "O-Cel-O" ®. The pad 36 is about ¼ inch–5/16 inch thick. The axial spacing of annular shoulder 24 upstream of annular support shoulder 26 is about 0.210 inches.

When pad 36 is assembled in housing 10, supported on screen 30, the upper surface 36a of pad 36 telescopes into sleeve 34b of flow-control disc 34, but the upper surface 36a of pad 36 is preferably spaced slightly below the underside of disc 34 to provide a very small spacing therebetween indicated at 35. The upper surface 36a of pad 36 could contact disc 34, but incoming water pressure will in effect depress surface 36a from disc 34. The central bore 34d and the seven equally spaced bores 34e provide for passage of water therethrough into chamber 35, and from there through pad 36 where the water spreads out laterally in passing through the body of pad 36, and with a coherent, soft, silent stream of water then issuing downwardly from pad 36 and through screen 30 to issue as a soft, coherent, non-spreading column E, bounded by the inner downstream edge 28 of barrel 12.

The upstream-arched 60-mesh screen 38 operates to provide a screening out of waterborne debris, and its downwardly and outwardly curved and sloping wall, as seen in FIGS. 2, 3, and 4, that extends radially outwardly and axially downstream, from the central and highest, or apex, portion of screen 38, operates so that any waterborne debris, that is stopped from passing through screen 38 will gravitate, or be urged by the force of the incoming water, off the central portion of screen 38 and laterally outwardly and downstream onto the annular area 40b on the upstream side of seal 40, where the captured debris, although accumulated, will be less likely to interfere with flow of water through the stream former.

In the form of device shown in FIG. 3, the principal difference over what is disclosed in FIGS. 2 and 4 is that where the stream former 10 in FIGS. 2 and 4 is female-threaded at 22 adjacent its upstream end for screw-on connection to a male-threaded faucet spout F, the stream former's barrel 12', shown in FIG. 3, is male-threaded at 122 for screw-on connection to a female-threaded faucet spout F' with female threads 124. Elements in FIG. 4 corresponding with those shown in FIG. 2 carry the same element designation as in FIG. 2 with a prime mark (') added.

In operation, incoming water first passes through arched fine-mesh screen 38, then through bores 34d and 34e in flow-control plate 34 into the shallow depth chamber 35, and then downwardly through pad 36, and finally issues through the 40-mesh screen 30 and past cylindrical wall 28 at the discharge end of the stream former 10, so that what issues is a stream S that comes out as a substantially cylindrical column of water surrounded by envelope E, that is soft and silky to the touch, but is in non-aerated condition and without any substantial lateral spreading.

Tests of rate of discharge of devices constructed in accord with FIG. 2 of this disclosure reveals the following:

| Upstream Water Entry Pressure PSI | Outflow Using A Plastic Shell On A "Delta" ® Faucet G.P.M. | Outflow Through A Stream Former That Uses A Brass Shell At The End Of A ½" I.D. Pipe G.P.M. | Issuing Stream Appearance |
|---|---|---|---|
| 20 | 1.6 | 1.4 | No Distortion |
| 30 | 1.8 | 1.6 | No Distortion |
| 40 | 2.0 | 1.8 | No Distortion |
| 50 | 2.2 | 2.0 | No Distortion |
| 60 | 2.4 | 2.2 | Slight Distortion |
| 70 | 2.5 | 2.3 | Slight Distortion |
| 80 | 2.6 | 2.4 | Slight Distortion |

While particular embodiments of this invention have been shown and described, it will be obvious to those skilled in the art that various changes and modifications may be made therein without departing from the spirit and scope of the invention and, therefore, it is intended in the appended claims to cover all such changes and modifications which fall within the true spirit and scope of the invention.

What is claimed is:

1. In a stream former, for transforming a turbulent flow of water, that would normally issue from a spout of a faucet, into a coherent, silent, non-splashing, non-aerated stream of water, and wherein, there extends, from a downstream end of the faucet spout, a tubular discharge member with imperforate walls and with a discharge end that is shaped to support a transverse screen or perforated member;

the improvement comprising, in combination:

an axially elongated, tubular barrel with a lowermost discharge end from which a well defined, silent, non-splashing, non-aerated, stream of water is to issue, and with an uppermost attachment end constructed for selective screw on attachment to the downstream end of the faucet spout;

said barrel containing and supporting, therewithin, a downstream screen disc of fine mesh;

a cylindrical, axially compressible, flow through disc, supported on the upstream side of said downstream screen disc, and being formed as a pad, of closely woven, non-shedding, matted nylon fibers, through which water will flow;

an upstream fine-mesh filter screen being shaped in the form of an arched dome whose center portion projects upstream toward the downstream end of the faucet spout, and whose outermost peripheral edge extends downstream and outwardly, somewhat frusto-conically at the outermost portion thereof, said outermost portion of said upstream screen being embedded at its outermost extent in a molded, resilient, compressible annular seal gasket, of greater thickness than the resilient screen;

said seal gasket being positioned to have its upstream surface sealingly engaged by the discharge terminus of the faucet spout;

a molded flow control disc having a downstream extending, sleeve portion for supporting said disc on an annular shoulder that is provided upon an inner wall of the barrel, said flow control disc having an axially thickened, flow control portion that is located in a region spaced between the upstream surface of said axially compressible, flow through disc and the underside of the central portion of said upstream fine-mesh filter screen;

an upperside of the flow control disc providing, on its upstream, outer peripheral edge, an annular, peripheral, upwardly facing support against which said resilient, compressible annular seal gasket is seated, said seal ring having an interior surface engaging an outer periphery of an upstream bulged portion of said flow control disc; and said control disc having a plurality of flow through bores whose total water-passing area is much less than the downstream flow discharge area provided by the screen disc at the discharge end of the stream former barrel.

2. A construction as in claim 1 wherein the thickness of the cylindrical compressible disc of nylon, prior to compression, is in the range of about ¼"–5/16" thick.

3. A construction as in claim 2 where the cylindrical compressible disc of nylon fibers provides a tortuous path for flow of water passing therethrough.

4. A construction as in claim 1 wherein the ratio of the total water flow-through area of the upstream flow control disc is only about 1/30 of the total outflow area defined at the downstream end of the stream former barrel, and the fine-mesh downstream screen disc providing a rectangular grid of wires of about 40 cross wires per inch.

5. A construction as in claim 1 wherein the discharge effected from the discharge end of the stream former barrel is a coherent stream of water that has a soft and silky feel, without entrainment of air bubbles therein.

6. A construction as in claim 1, wherein the upstream fine mesh filter screen serves in part as a debris-screening member carried by the stream former barrel, with the construction of the debris-screening member being of a nature and shape to operate to prevent debris from clogging the path for water to flow through the flow bores provided in the upstream flow control disc.

7. A construction as in claim 6 wherein the upstream fine-mesh screen and the flow control disc cooperate so that water borne debris will be filtered out by said upstream screen may then gravitate, or be flushed, downwardly and outwardly to lie against the imperforate seal gasket, so as to prevent, to as great an extent as possible, blockage of the upstream screen.

8. A construction as in claim 1 wherein the diameter of the cylindrical compressible disc of nylon is about ¾" in diameter.

9. A construction as in claim 1 wherein the downstream screen is of 40 mesh and is selected from a group of non-corroding metals, such as brass, stainless steel, or plastic.

10. A construction as in claim 1 wherein the annular barrel is selected from a group of non-corroding materials that includes brass, plastic, and stainless steel.

11. A construction as in claim 1 wherein the material of the upstream flow control disc is molded of plastic.

12. The construction of claim 1 wherein the cylindrical compressible disc provides means to spread the flow of liquid so that the stream formed thereby passes through the entire cross-sectional area of the downstream screen disc.

13. The construction of claim 12 wherein the means to disperse the flow of liquid across the cylindrical compressible disc comprises spacing the top of the cylindrical compressible disc slightly below the bottom surface of the flow control disc so as to create a space therebetween, said space being filled with water when the stream former is in use, so that the water is directed to pass through the entire cross-sectional area of the cylindrical compressible disc, and the area size of the cylindrical compressible disc being greater than the area size of the discharge end of the barrel, so that the discharge end of the barrel serves to shape the stream issuing from the barrel.

14. The construction as in claim 1 wherein the apertured disc is provided with a downwardly extending sleeve-like flange, said sleeve-like flange supporting said flow control disc on the uppermost annular support, said flange having an inside diameter of a size that permits the top of the cylindrical compressible disc to be located within the area circumscribed by the flange, and said cylindrical compressible disc being designed to compress under the pressure of incoming liquid so as to provide a cavity between the bottom of the flow control disc and the top of said cylindrical compressible disc, said cavity filling with liquid so that the liquid is caused to pass through the entire cross-sectional area of the cylindrical compressible disc.

* * * * *